US007390948B2

(12) United States Patent
Walworth

(10) Patent No.: US 7,390,948 B2
(45) Date of Patent: Jun. 24, 2008

(54) CAPO APPLICABLE TO DOBRO AND SLIDE GUITARS, AND OTHER RAISED-STRING INSTRUMENTS

(76) Inventor: Bruce Walworth, 7640 Werkner Rd., Chelsea, MI (US) 48118

( * ) Notice: Subject to any disclaimer, the term of this patent is extended or adjusted under 35 U.S.C. 154(b) by 187 days.

(21) Appl. No.: 11/342,910

(22) Filed: Jan. 30, 2006

(65) Prior Publication Data

US 2007/0175312 A1 Aug. 2, 2007

(51) Int. Cl.
*G10D 3/04* (2006.01)

(52) U.S. Cl. ..... 84/318

(58) Field of Classification Search ..... 84/318
See application file for complete search history.

(56) References Cited

U.S. PATENT DOCUMENTS

| | | | | | |
|---|---|---|---|---|---|
| 7,279 | A | | 4/1850 | Ashborn | |
| 390,612 | A | | 10/1888 | Moffat | |
| 692,751 | A | * | 2/1902 | Winchell | 84/318 |
| 1,788,636 | A | | 1/1931 | Russell | |
| 3,185,012 | A | | 5/1965 | Dunlop | |
| 4,261,548 | A | * | 4/1981 | Kaderabek | 254/131 |
| 4,671,156 | A | * | 6/1987 | Hathcock | 84/318 |
| 4,746,098 | A | * | 5/1988 | Abarotin | 254/130 |
| 5,031,879 | A | * | 7/1991 | Umlauf, Jr. | 254/129 |
| 5,133,342 | A | * | 7/1992 | Seaton | 602/39 |
| 5,226,638 | A | * | 7/1993 | Ausilio | 269/238 |
| 5,284,077 | A | | 2/1994 | Ellis | 84/318 |
| 5,685,770 | A | * | 11/1997 | Wood, Sr. | 452/125 |
| 5,713,559 | A | * | 2/1998 | McClarin et al. | 254/124 |
| 6,005,174 | A | * | 12/1999 | Regen | 84/318 |
| D446,540 | S | | 8/2001 | Elliott | D17/20 |
| 6,271,448 | B1 | | 8/2001 | Steinberger | 84/318 |
| 6,410,832 | B1 | | 6/2002 | Sterner | 84/318 |
| 6,452,077 | B1 | | 9/2002 | Chapman et al. | 84/273 |
| 6,459,025 | B1 | | 10/2002 | D'Addario | 84/318 |
| 6,528,711 | B1 | | 3/2003 | Paige | 84/318 |
| 6,573,440 | B1 | | 6/2003 | Rodriguez | 84/318 |
| 6,635,813 | B2 | | 10/2003 | Campling | 84/318 |
| 6,835,880 | B1 | | 12/2004 | Silva | 84/318 |
| 6,958,439 | B1 | * | 10/2005 | White | 84/318 |
| 2007/0175312 | A1 | * | 8/2007 | Walworth | 84/318 |
| 2007/0187881 | A1 | * | 8/2007 | Dixon | 269/236 |

OTHER PUBLICATIONS

Resophonic Capos, (http://web.telia.com/~u86505074/capomuseum/Special/Dobro/resophonic.htm), viewed Sep. 25, 2007, presenting dates of introduction of various capos.*
Waldorth Dobro Capo, http://www.playbetterbluegrass.com/walworth_resonator_capo_4537_prd1.htm, viewed Sep. 25, 2007, date of availability for sale is not indicated.*
Elderly Instruments Catalog, pp. 42,49,57.
The Sterner Capo Museum Website.
Janet Davis Music Website.
www.beardguitars.com/capos.html.

* cited by examiner

*Primary Examiner*—Lincoln Donovan
*Assistant Examiner*—Robert W Horn
(74) *Attorney, Agent, or Firm*—Gifford, Krass, Sprinkle, Anderson & Citkowski, PC

(57) ABSTRACT

A capo for Dobro® and slide guitars, and other raised-string instruments is lever-operated and compression adjustable, enabling one-handed placement and removal and precise, consistent chord formation.

20 Claims, 8 Drawing Sheets

CAPO APPLICABLE TO DOBRO AND SLIDE GUITARS, AND OTHER RAISED-STRING INSTRUMENTS

FIELD OF THE INVENTION

This invention relates generally to capotastos or "capos," and, in particular, to a capo adapted for use with Dobro and slide guitars, and other raised-string instruments.

BACKGROUND OF THE INVENTION

A capo is a device used to shorten the string length on guitars and other musical instruments, thereby facilitating upward transposition without altered fingering. The term has European roots: "capotasto," from Italian, "capo" meaning "head" and "tasto" meaning "tie, fret, or key." In French the capo is called a barre, and in German, capodaster). Originally this term denoted the nut of a fretted instrument such as the lute or guitar. The term was first employed by G. B. Doni in his annotazioni of 1640. The term "capo" is now used to describe a device used to shorten string length, thereby facilitating upward transposition relative to the fret board without altered fingering.

According to the Sterner Capo Museum (http://web.telia-.com/~u86505074/capomuseum), the first capo was invented in the mid 1700's. Both the yoke capo with screw and the wooden Spanish capo cejilla were invented in the late 1700's. The yoke capo looks substantially the same today, and the Spanish capo is still in use by Flamenco guitarists. On English guitars at that time, the capo was attached through holes in the neck by a small carriage bolt tightened by a wing nut.

The first U.S. patent on the capo was U.S. Pat. No. 7,279, entitled "Guitar Head," which issued in 1850 to James Ashborn. As shown in FIG. 1, the Ashborn capo was tightened by an eccentric roll (k) on the back of the neck (j). Referring to FIG. 2, U.S. Pat. No. 390,612, entitled "Capodastro for Guitars," which issued to George D. Moffat on Oct. 2, 1888 describes a capo including a C-shaped mounting member (B), a pressure bar (D) which is hinged or pivoted to the C-shaped mounting member. The pressure bar is self-adjusting and is free to tilt about its point of pivotal suspension so that it can properly depress the strings regardless of the capo's position on the guitar-stem. The Moffat capo further includes a cam lever (C) which is eccentrically pivoted upon the C-shaped mounting member to urge the pressure bar against the back of the neck, thereby compressing the strings. The pressure bar may be provided with a pad (a) of cork or any other suitable material so that the pressure bar does not injure the strings. An alternative embodiment includes a bearing plate operated by an adjusting screw so that the capo may be clamped to the guitar neck.

Two capos still in use today include the Bill Russell capo and the Jim Dunlop capo. The Bill Russell capo is the subject of U.S. Pat. No. 1,788,636, entitled "Capo Tasto" (FIG. 3). The Russell capo includes a rubber pressure bar (2), which presses against the strings of a stringed instrument, a rigid reinforcing plate (1) which is positioned inside of or on top of the rubber pressure bar and to which the rubber pressure bar is secured, an elastic strip (5), a portion of which is secured to a first lug on the rubber pressure bar at one end extending over the top of the rubber pressure bar, and secured to a second lug on the rubber pressure bar. The Russell capo is secured to the stem of the stringed instrument by wrapping the remaining portion of the elastic strip about the bottom surface of the stem. The tension on the elastic strip is maintained by a plurality of eyelets (7) positioned on the elastic strip to which a set of pins are coupled.

The Jim Dunlop capo is the subject of U.S. Pat. No. 3,185,012, also entitled "Capo Tasto" (FIG. 4). The Dunlop capo includes a channel of a roughly U-shaped cross-sectional contour (16) molded from plastic, the side flanges which are arranged to diverge slightly and have beveled end edges. A non-elastic cord (26) is coupled to a cam lever (42), which is aligned perpendicular to the longitudinal axis of the stem of a stringed instrument on which it is placed and which secures the capo in place on the stem of the stringed instrument. Depending upon the thickness of the neck of the instrument, disk-shaped beads (44) are placed in corresponding recesses 28, and the device is tightened around the strings when the lever 42 is flipped down into the U-shaped channel.

The first patented plastic capo is described in U.S. Pat. No. 3,823,247 (FIG. 5). This capo includes a pressure bar (1), a bowed clamp member (2) hinged to one end of the pressure bar, and a coupling which interengages the other, unhinged end of the pressure bar in order to secure the capo to the guitar. The pressure bar has a comb-like part (8), the teeth of which are closely spaced and adapted to press on the strings of the instrument. The disadvantage in using this capo is that a musician must use both his hands to change from one fret position to another fret position. The advantage of this capo is its aesthetic qualities in that it is practically invisible when placed on a stringed instrument.

As might be expected, there are specialized capos for specialized guitars. One specialized guitar, the Dobro®, has been around since the mid 1920's. The Dobro trademark is now owned by the famous maker Gibson. Guitars of this type, built by independent guitar makers, are referred to as resonator, or, resophonic, guitars. FIG. 6 is a drawing of a classic Dobro guitar.

Resophonic guitars arose out of a need for a louder acoustic instrument, able to compete with the trumpets, saxophones and banjos that dominated popular music in the 1920s. As the story goes, George Beauchamp, a Los Angeles guitarist, took his vision of a mechanically amplified instrument to John Dopyera and his brother Rudy, Slovakian immigrants who had already patented several improvements for banjos. John Dopyera perfected a design utilizing three aluminum cones, Rudy suggested a metal body to enhance amplification, and the National tri-cone resonator guitar debuted in 1927. John Dopyera left National in 1928 and began developing a more affordable wood body guitar with a single cone and a spider-like bridge base. He introduced his new invention by the end of 1928 under the name DOBRO®—a combination of Dopyera and "brothers."

Dobro guitars, like some slide guitars, are typically played on the musician's lap. Since the strings are spaced a considerable distance from the finger board, traditional clamping-type capos either will not work, will damage the instrument, or both. Thus, specialized capos were invented. Although some of the capos do extend around the back of the neck, most models do not and instead 'float' on the strings.

One of the first commercially produced floating capos is the Huckabee capo, developed in the early 1980s. With this design, a thin, round bar with plastic tubing, pulls the strings up towards a heavy, square bar by means of a screw and a wing nut. Along the bottom side of the square bar there is a routed grove to give it two distinct edges against the strings and the strings are pulled into that grove. The round bar is the Beard capo, designed by Paul E. Beard in 1985. Referring to FIG. 7, the square brass bar 702 is wider and lower. Instead of a routed grove, this capo has a bone edge 704 and a leather pad 706 to mute the strings behind the capo. Tightening is nevertheless carried out with a nut 708 coupled to sleeved bar 710 biased away from bar 702 with spring 712. A further development, shown in FIG. 8, was to replace the wing nut with an eccentric lever 802 in a capo reportedly made by Liberty in the early 1980s.

SUMMARY OF THE INVENTION

This invention resides in a capo for Dobro® and slide guitars, and other raised-string instruments. In contrast to previous designs, the capo is lever-operated and compression adjustable, enabling one-handed placement and removal and precise, consistent chord formation.

The preferred embodiment includes a bar member having length defined by two ends, an upper surface, and a lower surface adapted for string contact. A sliding link member extends through a central bore in the bar member, the link member having an upper end positioned above the upper surface of the bar member and a lower end positioned below the lower surface of the bar member. A clamping member extends through a bore formed through the lower end of the link member, the clamping member having two opposing arms extending away from the link member, each arm terminating proximate to a respective end of the bar member. An adjustment arm, pivotally coupled to the upper end of the link member, includes a first end with an adjustment mechanism that engages with the upper surface of the bar member, a second end pivotally coupled to a clamping lever. The clamping lever includes user-graspable portion and a corner spaced apart from the pivotal attachment to the link member, such that when the user-graspable portion of the lever is folded down onto the upper surface of the bar member, the clamping member is brought sufficiently close to the lower surface of the bar member to trap strings disposed therebetween to effectuate a chord formation, and when the user-graspable portion of the lever is lifted up and away from the upper surface of the bar member, the strings are released, allowing the capo to be removed or repositioned.

The bar member includes a longitudinal groove, thereby creating a string-contacting edge. The central bore through the bar member is square or otherwise non-circular to ensure that the clamping member and the bar member are at all times substantially parallel. In the preferred embodiment the clamping member defines a cross-sectional area which is less than the cross-sectional area of the bore formed through the lower end of the link member, thereby allowing the clamping member to slightly pivot and accommodate strings of graduating diameter. The two opposing arms of the clamping member are covered with a compressible, resilient sleeve. The preferred clamping lever is generally triangular in shape, and a spring disposed between the bottom surface of the bar member and the clamping member biases the clamping member away from the bar member. At least the bar member is constructed from brass or other substantially heavy material, and the preferred adjustment mechanism is a set screw.

In the preferred embodiment, the pivotal coupling of the adjustment arm to the upper end of the link member is positioned closer to the link member than to the adjustment mechanism, and the adjustment mechanism is proximate to one of the ends of the bar member.

DETAILED DESCRIPTION OF THE INVENTION

Figure 9:
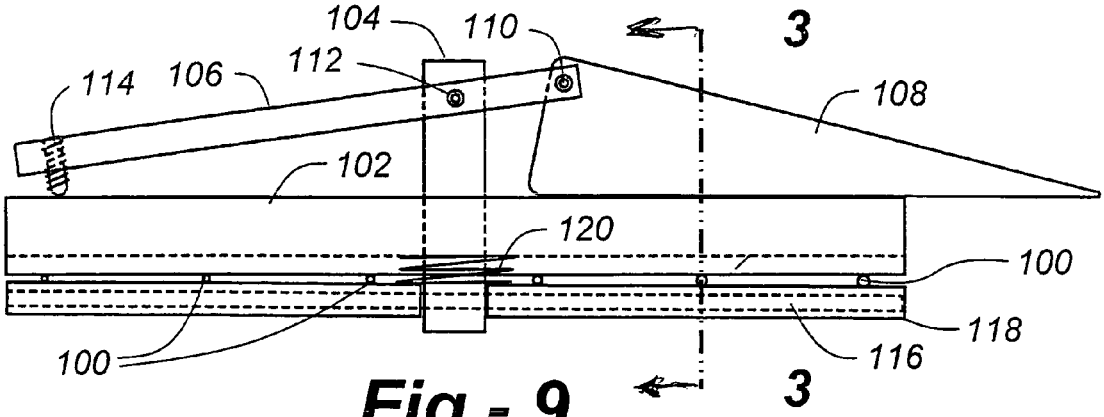
FIG. 9 illustrates, from a side-view perspective, the preferred embodiment of the invention.

Referring now to the drawings, FIG. 9 illustrates, from a side-view perspective, the preferred embodiment of the invention. The capo includes a bar member 102 through which a link member 104 attaches to a clamp member 116. The link member 104, and the bore through the bar member 102, are square or some other non-round shape to ensure that the clamp member 116 is at all times substantially aligned with the bar member 102.

At the upper end of the link member 104, an adjustment arm is pivotally attached at 112. One end of the adjustment arm 106 is pivotally attached to a lever 108, with the other end of the adjustment arm, including a set screw 114 or other such device to raise and lower that end of the adjustment arm relative to the top surface of the bar member 102. The clamp member 116 has opposing arms covered with polymeric sleeves 118 on either end to ensure a positive grip on strings 100 when the lever 108, pivotally attached to adjustment arm 106 at point 110, is folded down onto the top of the bar member 102, as shown.

In the preferred embodiment, the bore formed through the bottom portion of the link member 104 is slightly larger than the size of the clamp member 116, to facilitate a limited degree of tilting movement and to accommodate the change in string diameters from high pitched to bass. The spring 120 is also provided to bias the clamp member 116 away from the bar member 102 when the lever is lifted up, releasing the strings, as shown in FIG. 12.

The geometry of the adjustment arm 106, as well as the pivot points 110, 112 and position of adjustment screw 114 are chosen such that when the lever 108 is folded down onto the top of the bar member 102, as shown in FIG. 9, screw 114 may be backed out or advanced, as the case may be, to provide a precise positive pressure on the strings, allowing the capo to be removed and returned to the strings with the same pressure upon the next use thereof. In terms of materials, it is determined that metal, particularly heavier metals, such as brass, work well due to their dampening capability, though other materials may be used, as appropriate. Set screw 114, compression axles 110, 112, and link member 104 are preferably steel. Clamp member 116 is also steel, preferably hardened steel, to minimize fatigue after repeated use.

Figure 1:
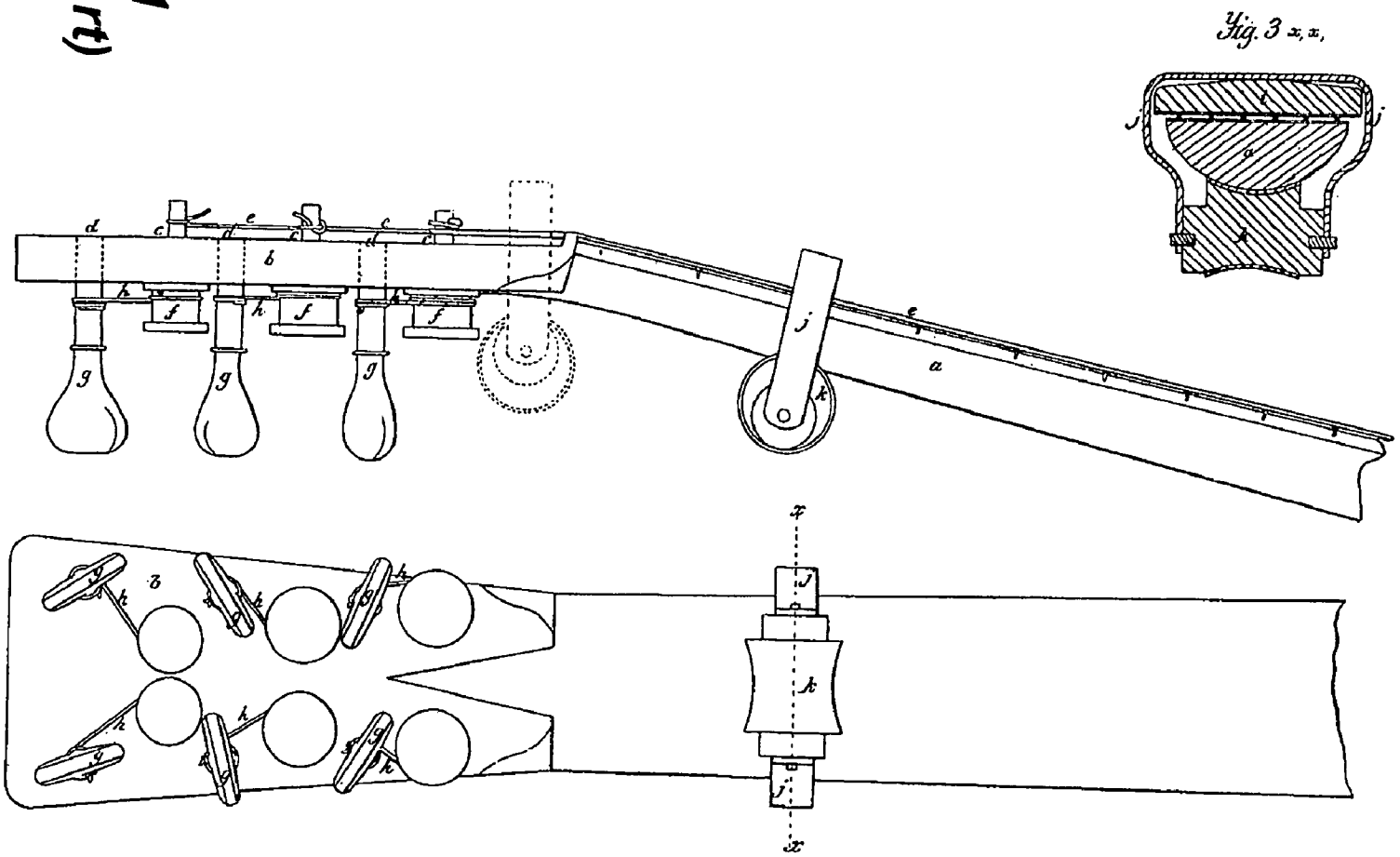
Fig - 1 (Prior Art)
FIG. 1 is an image of the front page of U.S. Pat. No. 7,279, entitled "Guitar Head," which issued in 1850.
Figures 1, 2:
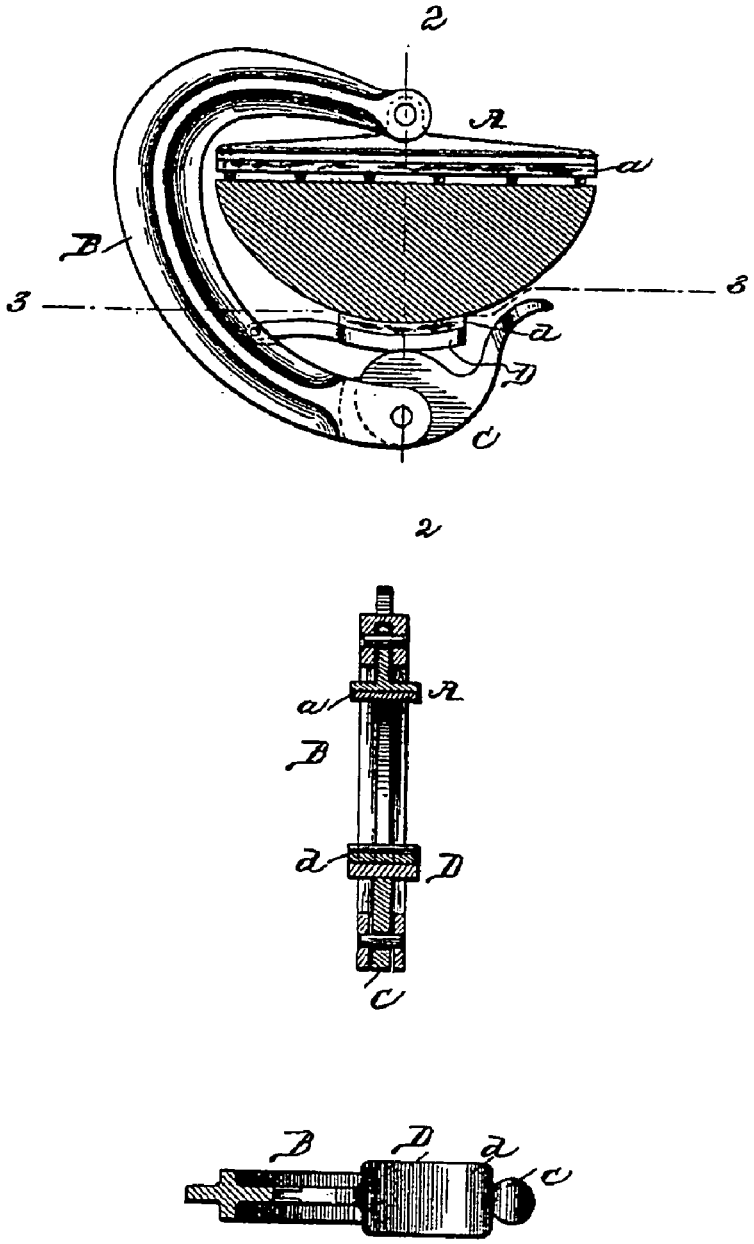
Fig - 2 (Prior Art)
FIG. 2 is an image of the front page of U.S. Pat. No. 390,612, entitled "CAPODASTRO FOR GUITARS" which issued in 1888.
Figure 3:
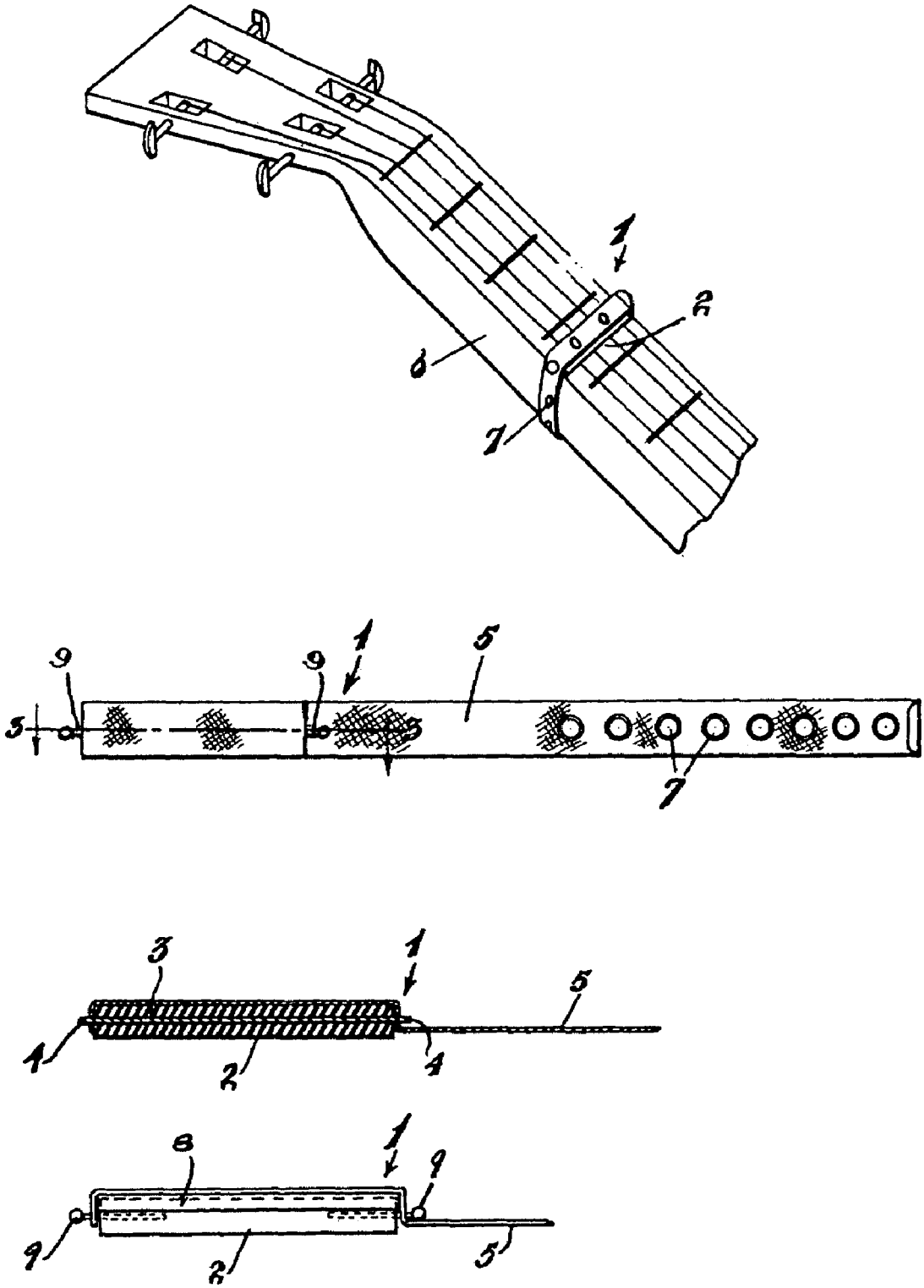
Fig - 3 (Prior Art)
FIG. 3 is an image of the front page of U.S. Pat. No. 1,788,636, entitled "CAPO TASTO" which issued in 1931.
Figure 4:
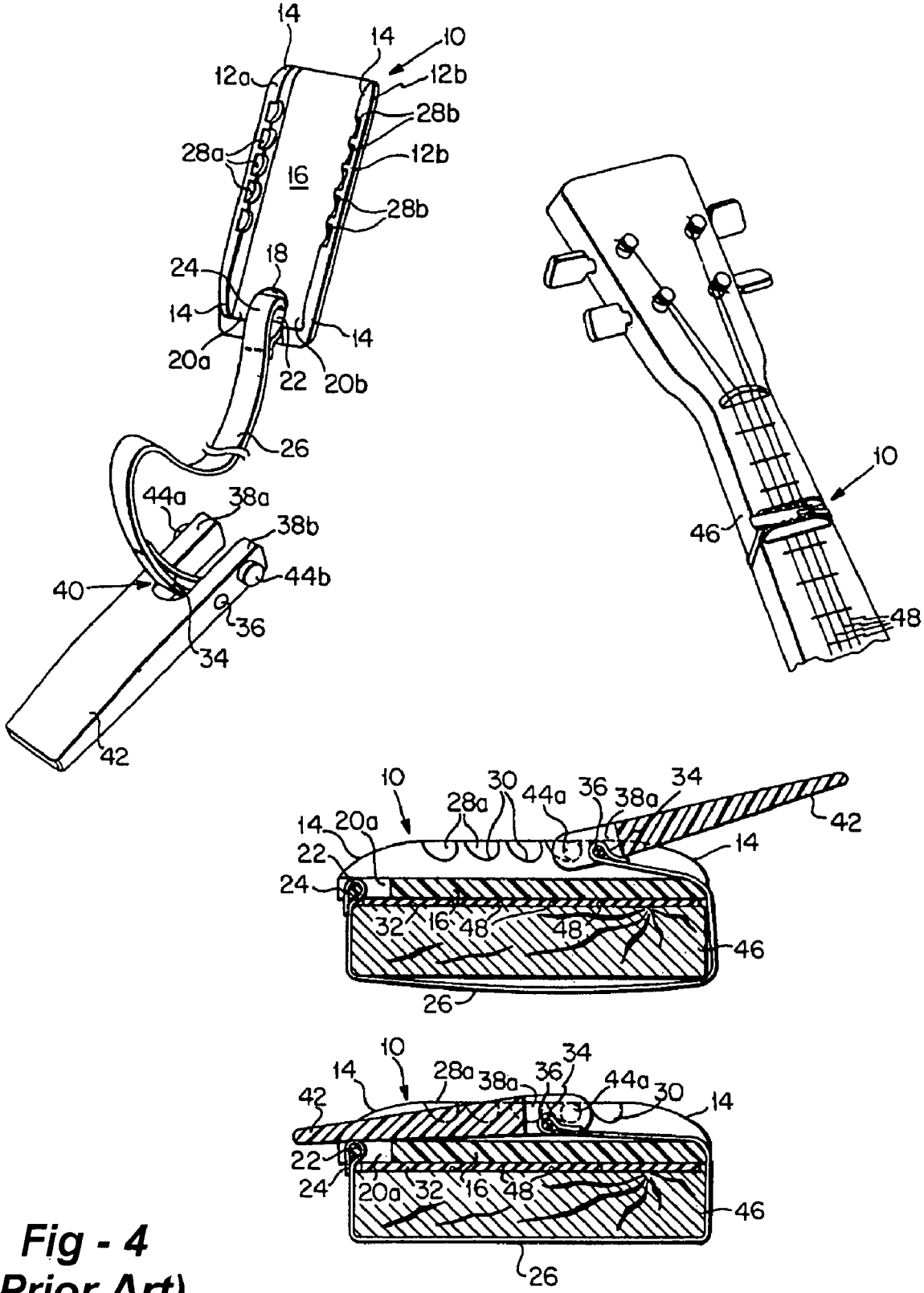
Fig - 4 (Prior Art)
FIG. 4 is an image of the front page of U.S. Pat. No. 3,185,012, entitled "CAPO TASTO" which issued in 1965.
Figure 5:
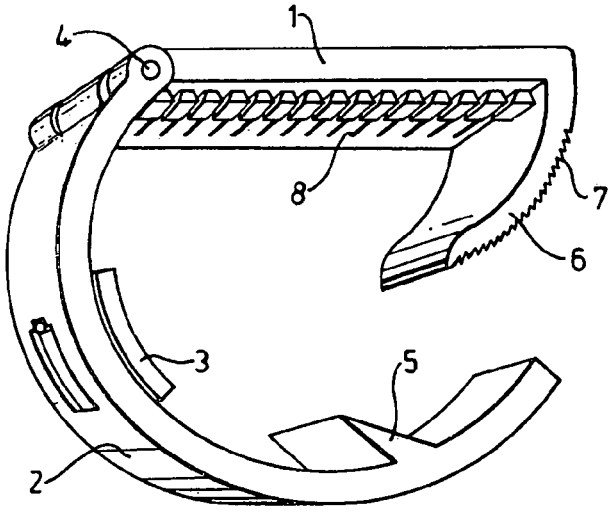
Fig - 5 (Prior Art)
FIG. 5 is an image taken from U.S. Pat. No. 3,823,247, which purportedly discloses the first patented plastic capo.
Figure 6:
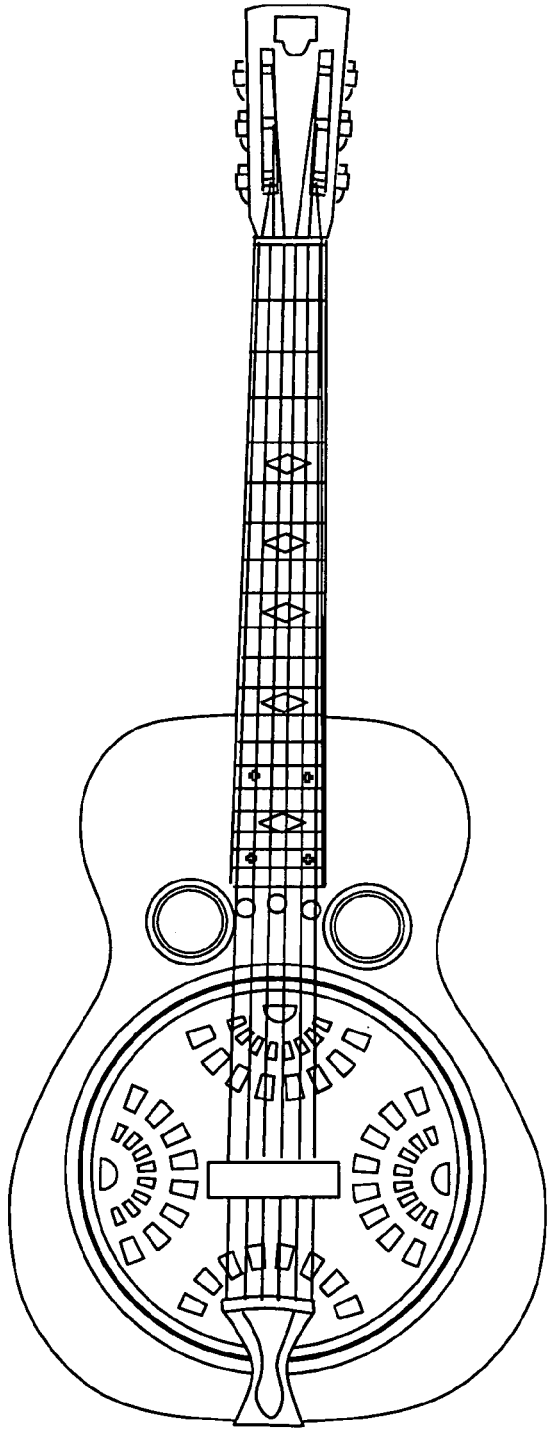
Fig - 6 (Prior Art)
FIG. 6 is a drawing of a classic Dobro® guitar.
Figure 7:
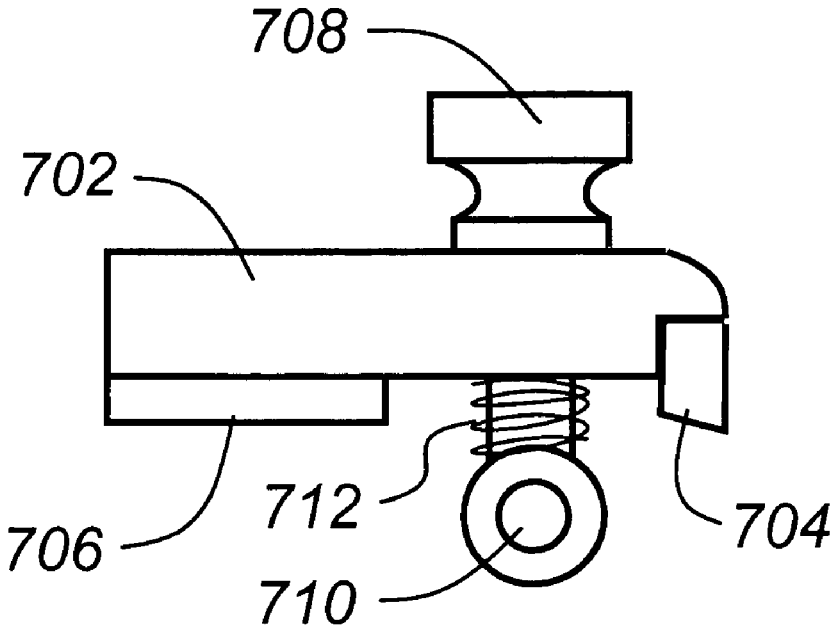
Fig - 7 (Prior Art)
FIG. 7 is a perspective drawing of a Beard capo from the early 1980s.
Figure 8:
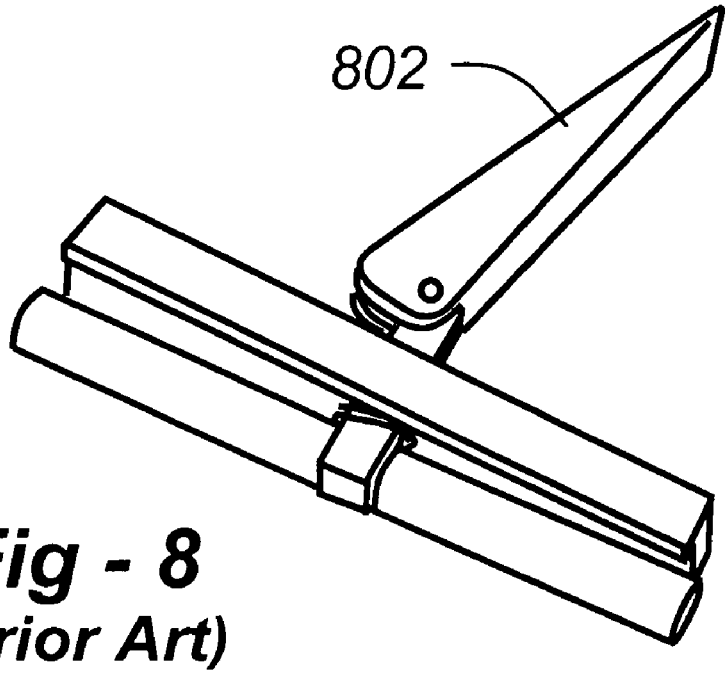
Fig - 8 (Prior Art)
FIG. 8 is a perspective drawing of a lever-operated Liberty capo, also from the early 1980s.
Figure 10:
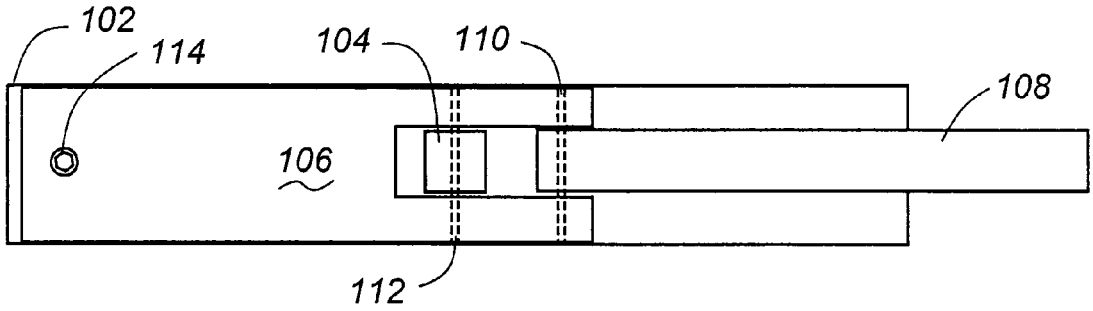
FIG. 10 is a top view of the preferred embodiment of FIG. 9, better illustrating the widths of the adjustment arm and lever.
Figure 11:
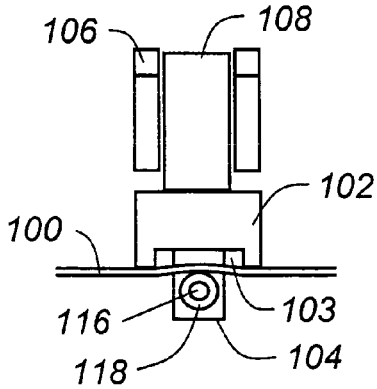
FIG. 11 is an end-view cross-section taken along lines 3-3 in FIG. 9, better illustrating the cross-sectional geometry of the bar member.

FIG. 10 is a top view of the preferred embodiment of FIG. 1, better illustrating the widths of the adjustment arm 106 and lever 108. FIG. 11 is an end-view cross-section taken along lines 3-3 in FIG. 1, better illustrating the cross-sectional geometry of the bar member 102. In particular, a longitudinal gap 103 is formed in the bar member, such that as the clamp member 116 with polymeric sleeve 118 is pulled up against a string 100 through the action of link member 104, a sharp line of chord formation is established.

Figure 12:
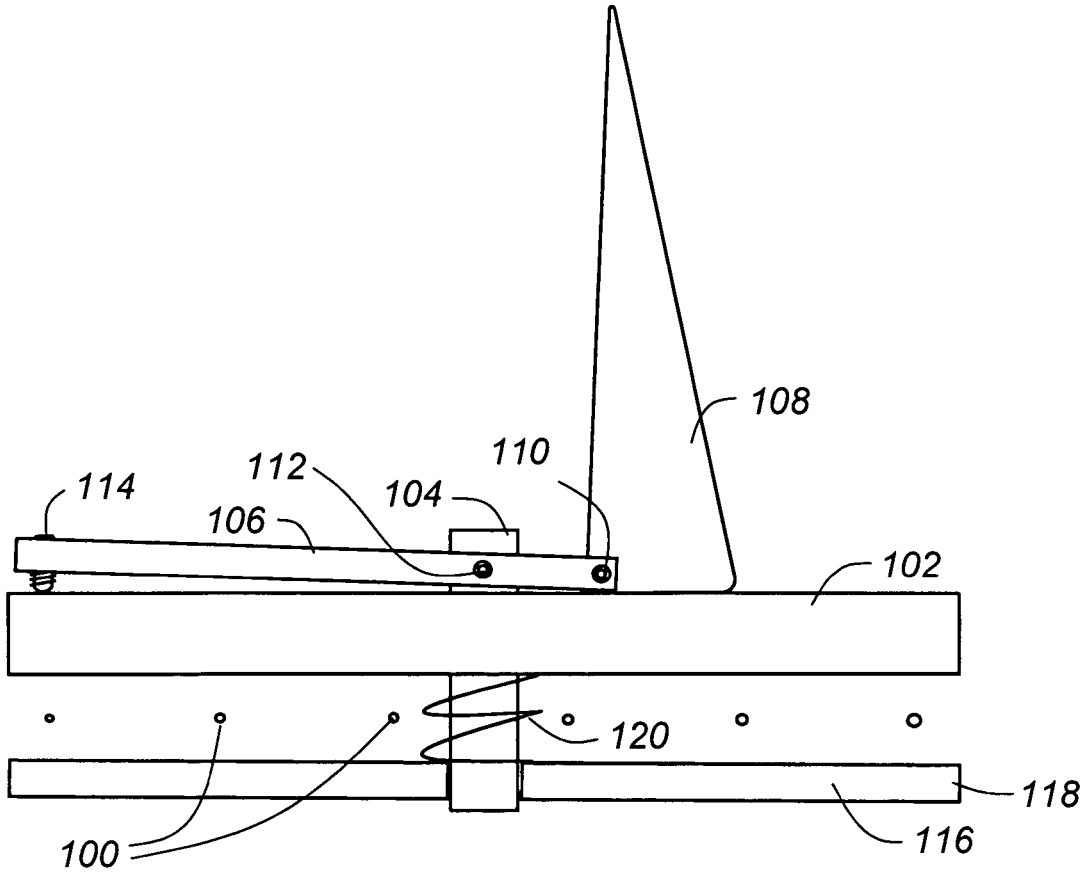
FIG. 12 illustrates how the clamp member is released.
Figure 13:
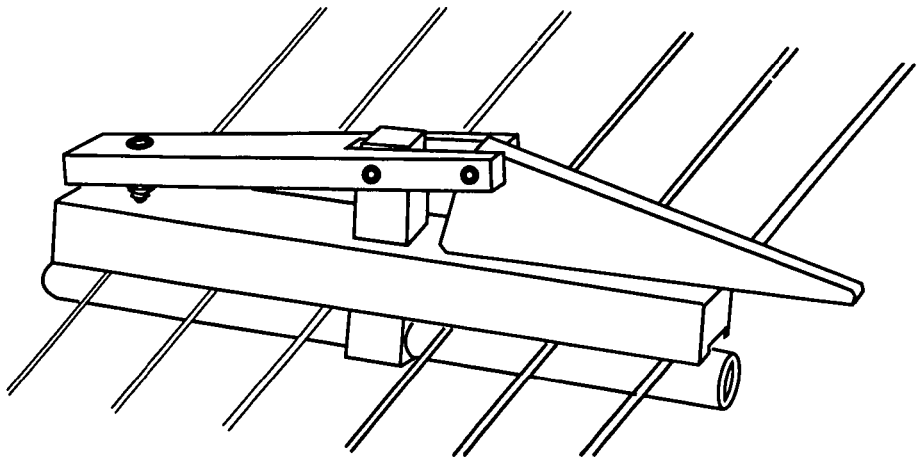
FIG. 13 is a perspective view of the preferred embodiment mounted on the strings of a musical instrument.

To use the capo according to the invention, the clamp member is released as shown in FIG. 12, and is inserted between the middle strings of the instrument and turned so that the bar member 102 is transverse or across all of the strings. When placed at a desired location by the musician, the lever 108 is flipped down on top of the bar member, clamping the strings for chord formation, as shown in FIG. 13. By virtue of the lever 108 in conjunction with adjustment arm 106, the capo according to the invention may be placed, removed and repositioned with one hand, thereby enhancing versatility.

I claim:

1. A capo for Dobro and slide guitars, and other raised-string instruments, comprising:

a bar member having length defined by two ends, an upper surface, and a lower surface adapted for string contact;

a sliding link member extending through a central bore in the bar member, the link member having an upper end positioned above the upper surface of the bar member and a lower end positioned below the lower surface of the bar member;

a clamping member extending through a bore formed through the lower end of the link member, the clamping member having two opposing arms extending away from the link member, each arm terminating proximate to a respective end of the bar member;

an adjustment arm pivotally coupled to the upper end of the link member, the adjustment arm having a first end with an adjustment mechanism that engages with the upper surface of the bar member, a second end pivotally coupled to a clamping lever; and wherein the clamping lever includes user-graspable portion and a corner spaced apart from the pivotal attachment to the link member, such that:

when the user-graspable portion of the lever is folded down onto the upper surface of the bar member, the clamping member is brought sufficiently close to the lower surface of the bar member to trap strings disposed therebetween to effectuate a chord formation, and when the user-graspable portion of the lever is lifted up and away from the upper surface of the bar member, the strings are released, allowing the capo to be removed or repositioned.

2. The capo of claim 1, wherein the lower surface of the bar member includes a longitudinal groove, thereby creating a string-contacting edge.

3. The capo of claim 1, wherein the central bore through the bar member is non-circular to ensure that the clamping member and the bar member are at all times substantially parallel.

4. The capo of claim 1, wherein the central bore through the bar member is square to ensure that the clamping member and the bar member are at all times substantially parallel.

5. The capo of claim 1, wherein the clamping member defines a cross-sectional area which is less than the cross-sectional area of the bore formed through the lower end of the link member, thereby allowing the clamping member to slightly pivot and accommodate strings of graduating diameter.

6. The capo of claim 1, wherein the two opposing arms of the clamping member are covered with a compressible, resilient sleeve.

7. The capo of claim 1, wherein the clamping lever is generally triangular in shape.

8. The capo of claim 1, further including a spring disposed between the bottom surface of the bar member and the clamping member operative to bias the clamping member away from the bar member.

9. The capo of claim 1, wherein at least the bar member is constructed from brass or other substantially heavy material.

10. The capo of claim 1, wherein the adjustment mechanism is a set screw.

11. The capo of claim 1, wherein the pivotal coupling of the adjustment arm to the upper end of the link member is positioned closer to the link member than to the adjustment mechanism.

12. The capo of claim 1, wherein the adjustment mechanism is proximate to one of the ends of the bar member.

13. The capo of claim 1, wherein the adjustment mechanism is proximate to one of the ends of the bar member.

14. A capo for Dobro and slide guitars, and other raised-string instruments, comprising:

a bar member having length defined by two ends, an upper surface, and a lower surface adapted for string contact;

a sliding link member extending through a central bore in the bar member, the link member having an upper end positioned above the upper surface of the bar member and a lower end positioned below the lower surface of the bar member;

a clamping member extending through a bore formed through the lower end of the link member, the clamping member having two opposing arms extending away from the link member, each arm being covered with a compressible, resilient sleeve terminating proximate to a respective end of the bar member;

the clamping member defining a cross-sectional area less than the cross-sectional area of the bore formed through the lower end of the link member, thereby allowing the clamping member to slightly pivot and accommodate strings of graduating diameter;

a spring disposed between the bottom surface of the bar member and the clamping member operative to bias the clamping member away from the bar member;

an adjustment arm pivotally coupled to the upper end of the link member, the adjustment arm having a first end with an adjustment mechanism that engages with the upper surface of the bar member, a second end pivotally coupled to a clamping lever; and wherein the clamping lever is generally triangular in shape, including a user-graspable portion and a corner spaced apart from the pivotal attachment to the link member, such that:

when the user-graspable portion of the lever is folded down onto the upper surface of the bar member, the clamping member is brought sufficiently close to the lower surface of the bar member to trap strings disposed therebetween to effectuate a chord formation, and when the user-graspable portion of the lever is lifted up and away from the upper surface of the bar member, the strings are released, allowing the capo to be removed or repositioned.

15. The capo of claim 14, wherein the lower surface of the bar member includes a longitudinal groove, thereby creating a string-contacting edge.

16. The capo of claim 14, wherein the central bore through the bar member is non-circular to ensure that the clamping member and the bar member are at all times substantially parallel.

17. The capo of claim 14, wherein the central bore through the bar member is square to ensure that the clamping member and the bar member are at all times substantially parallel.

18. The capo of claim 14, wherein at least the bar member is constructed from brass or other substantially heavy material.

19. The capo of claim 14, wherein the adjustment mechanism is a set screw.

20. The capo of claim 14, wherein the pivotal coupling of the adjustment arm to the upper end of the link member is positioned closer to the link member than to the adjustment mechanism.

* * * * *